US007325785B2

(12) United States Patent
Krengel et al.

(10) Patent No.: US 7,325,785 B2
(45) Date of Patent: Feb. 5, 2008

(54) STORAGE APPARATUS

(75) Inventors: Kenneth W. Krengel, Chicago, IL (US); Joseph T. Hudson, Chicago, IL (US); Paul Hatch, Northbrook, IL (US); Troy Livingston, Northbrook, IL (US)

(73) Assignee: The Design Society, Inc., Chicago, IL (US)

( * ) Notice: Subject to any disclaimer, the term of this patent is extended or adjusted under 35 U.S.C. 154(b) by 483 days.

(21) Appl. No.: 11/004,442

(22) Filed: Dec. 3, 2004

(65) Prior Publication Data

US 2006/0120846 A1 Jun. 8, 2006

(51) Int. Cl.
*B66D 1/36* (2006.01)

(52) U.S. Cl. ..... 254/338; 211/17

(58) Field of Classification Search ..... 254/333, 254/334, 338, 362; 211/17, 1.57, 117; 248/329
See application file for complete search history.

(56) References Cited

U.S. PATENT DOCUMENTS

| | | | | |
|---|---|---|---|---|
| 983,957 | A * | 2/1911 | Trantham | 254/338 |
| 5,263,687 | A * | 11/1993 | Garbiso | 254/334 |
| 5,984,275 | A * | 11/1999 | Hoslett | 254/338 |
| 6,152,427 | A * | 11/2000 | Hoslett | 254/338 |
| 6,161,702 | A * | 12/2000 | Campbell | 211/17 |
| 6,361,022 | B1 * | 3/2002 | Lob et al. | 254/338 |
| 6,386,515 | B1 * | 5/2002 | Sachtleben | 254/338 |

* cited by examiner

*Primary Examiner*—Emmanuel M Marcelo
(74) *Attorney, Agent, or Firm*—Neal, Gerber & Eisenberg, LLP

(57) ABSTRACT

A storage apparatus is disclosed. The storage apparatus comprises a mounting mechanism, a hoist system and a storage member. The hoist system, which is attached to the mounting mechanism, comprises at least one pulley. A hoist wire is disposed within each of the at least one pulleys. A hoist wire mount receives a first end of each of the hoist wires and a power source. Finally, the storage member is affixed to a second end of each of the hoist wires.

3 Claims, 8 Drawing Sheets

STORAGE APPARATUS

FIELD OF THE INVENTION

The Present Invention is directed to storage apparati and, in particular, to storage apparati that allow the storage apparatus unit to be removably disposed within a structure, such as, for example, through the raising and/or lowering from a ceiling and/or wall structure.

BACKGROUND OF THE INVENTION

Various types of storage apparati and systems have been developed and formulated to improve storage efficiency and organization, especially in situations in which space is at a premium. The need for such storage has only increased with current trends in real estate, in which rising costs have led to an emphasis of maximizing livable floor space. This has led to a desire for "out of the way" storage locations for items that are seldom used.

U.S. Pat. No. 6,357,832, issued to Nott, et al., and entitled "Overhead Storage Device," discloses one such storage apparatus. In Nott, a storage device is disclosed which is pivotally or rotatably mounted to an overhead surface, and accessed through the use of a motorized actuator assembly.

U.S. Pat. No. 5,725,293, issued to Wilkening, et al., and entitled "Overhead Storage Unit," also discloses a version of a storage apparatus. In Wilkening, the storage unit is described as a pull-down unit for use in overhead areas. This type of pull-down storage unit is also disclosed in U.S. Pat. No. 5,460,280, issued to Feddeler, and entitled "Suspended Storage Assembly."

However, none of the references cited herein, or any other references within the public domain, provide for a storage apparatus that can be easily accessed without a high degree of effort. Further, the current storage apparati described in the references above are not represented in a manner which is aesthetically pleasing; that is, the storage apparati do not "fit" within their environment.

Although these storage units work for their intended purposes, a continual need exists for novel approaches which further utilize available storage space. Thus, the need exists for a storage unit that can be easily accessed without a high degree of effort.

Please note that, the descriptions of the references in this, or any other, section are not intended to constitute an admission that such references are "Prior Art" with respect to the Present Invention, unless designated as such.

SUMMARY OF THE INVENTION

In accordance with the tenets and teachings of the Present Invention, a storage apparatus is disclosed. The storage apparatus comprises a mounting mechanism, a hoist system and a storage member. The hoist system, which is attached to the mounting mechanism, comprises at least one pulley. A hoist wire is disposed within each of the at least one pulleys. A hoist wire mount receives a first end of each of the hoist wires and a power source. Finally, the storage member is affixed to a second end of each of the hoist wires.

A better understanding of the objects, advantages, features, properties and relationships of the Present Invention will be obtained from the following detailed description and accompanying drawings, which set forth illustrative embodiments and are indicative of the various ways in which the principles, of the Present Invention may be employed.

BRIEF DESCRIPTION OF THE DRAWINGS

For a more thorough understanding of the Present Invention, reference may be had to the various embodiments described herein, as illustrated in the following drawings, in which.

DETAILED DESCRIPTION OF THE PRESENTLY-PREFERRED EMBODIMENTS

The Present Invention is discussed herein in relation to storage apparati with specific applications discussed in relation to storage apparati that can be raised and lowered from a ceiling structure; however, other uses will be apparent from the teachings disclosed herein. The Present Invention will be better understood from the following detailed description of exemplary embodiments, with reference to the attached Figures, and by reference to the following Claims.

Figure 1:
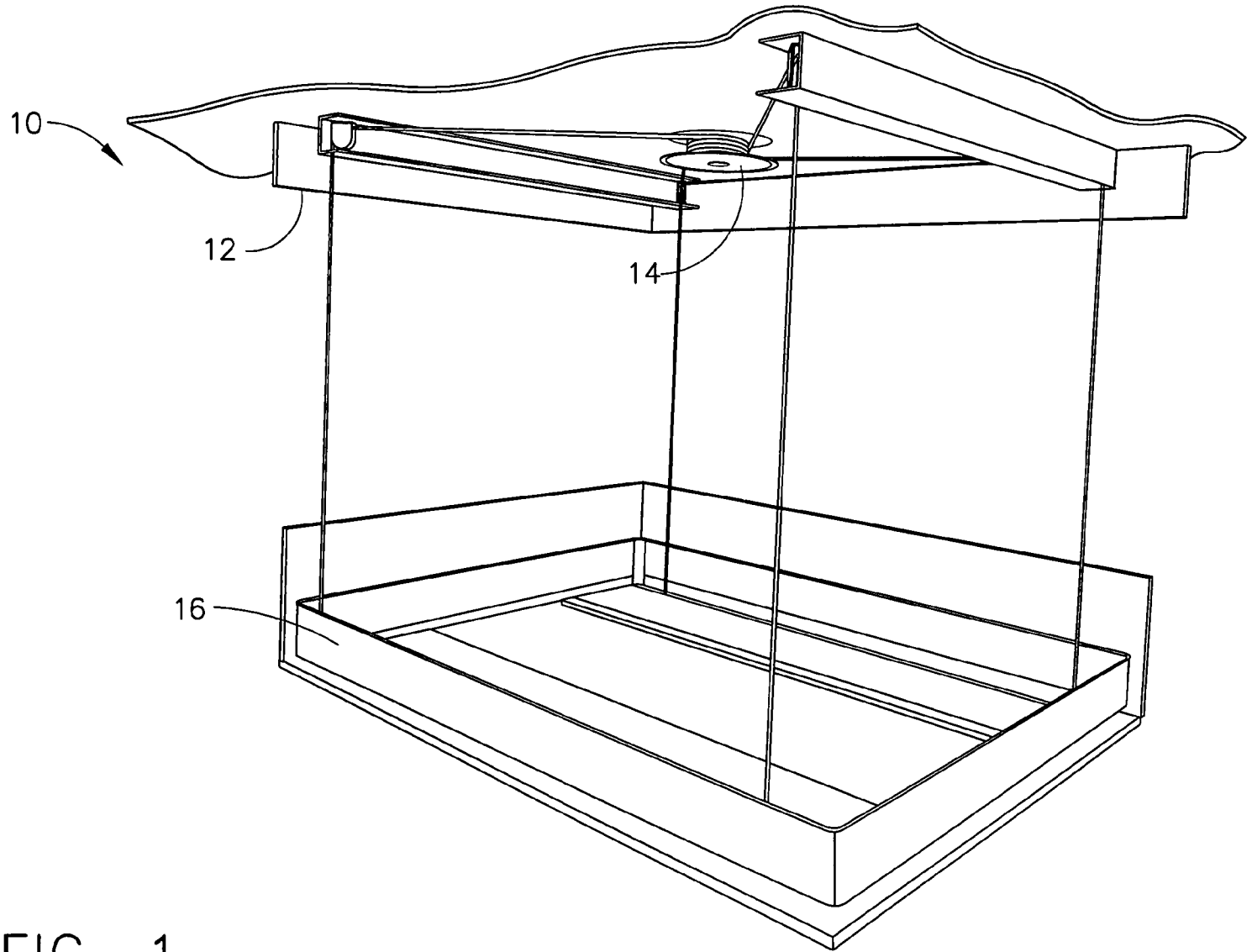
FIG. 1 illustrates a perspective view of one embodiment of a storage apparatus, manufactured in accordance with the teachings of the Present Invention.

Turning now to the Figures, in which like reference numerals refer to like elements, various embodiments of a storage apparatus, manufactured in accordance with the tenets and teachings of the Present Invention described herein, are illustrated. FIG. 1 illustrates a perspective view of one such embodiment of the Present Invention. As shown in FIG. 1, storage apparatus 10 generally comprises mounting mechanism 12, hoist system 14 and storage member 16.

Although specific aesthetic and/or practical designs for mounting mechanism 12 are both envisioned and discussed herein, it is contemplated that mounting mechanism 12 may employ any known structural attachment means to which storage apparatus 10 may be mounted, secured, attached or otherwise affixed, to the bottom side of an interior ceiling, or other similar structure, of a room (the ceiling, or other structure to which storage apparatus 10 is attached, is illustrated in FIG. 1 as reference numeral 18).

Further, although it is preferred that storage apparatus 10 be mounted to the bottom side of an interior ceiling of a room, it is nevertheless contemplated that the Present Invention may be adapted to be lowered from a vertical wall; in which case, a top portion of storage apparatus 10 may be lowered from a top end while maintaining a bottom end in a fixed and/or hinged relationship with the wall. It is also contemplated that storage apparatus 10 may be mounted in any external location, such as, for example, above or below a balcony or other similar exterior frame. Thus, storage apparatus 10 may be mounted to any structure, or portion thereof, that can be adapted to receive storage apparatus 10, and that will provide for the raising and/or lowering of at least a portion of storage apparatus 10.

Figure 2:
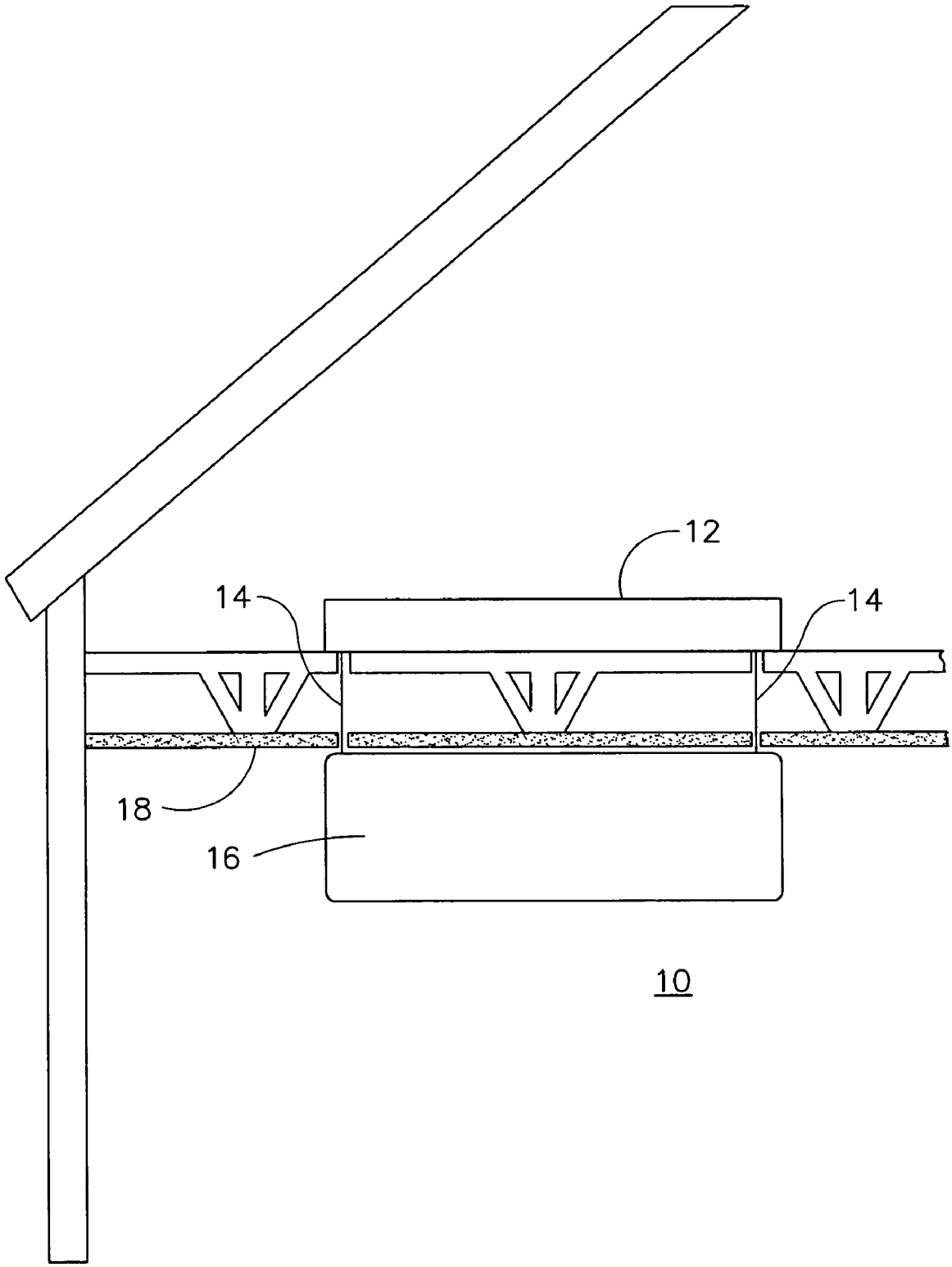
FIG. 2 illustrates a cross-sectional view of an alternative mounting embodiment for the storage apparatus of FIG. 1.
Figure 3:
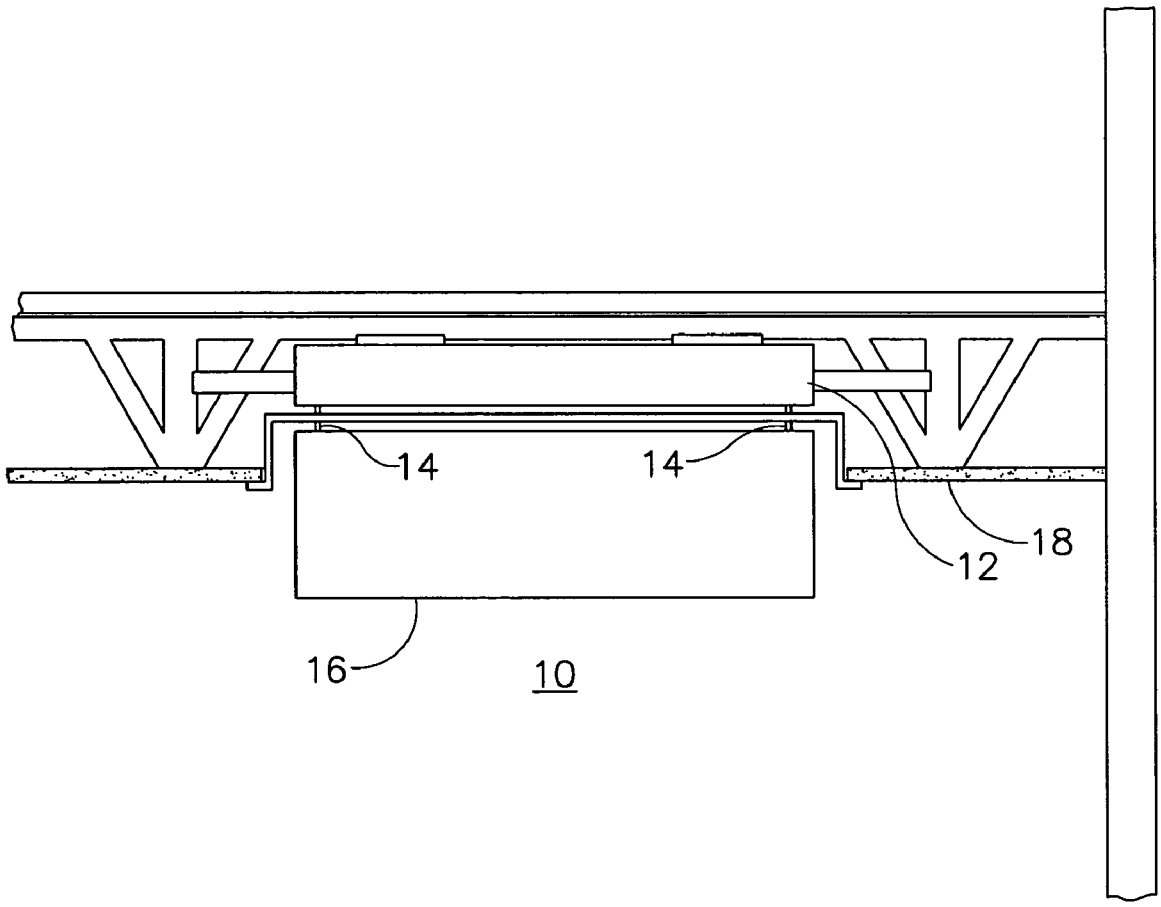
FIG. 3 illustrates a cross sectional view of a second alternative mounting embodiment for the storage apparatus of FIG. 1.

Additionally, as will be described below, storage apparatus 10 is preferably mounted directly to the bottom side of structure 18. This embodiment is illustrated in FIG. 1. Alternatively, as is illustrated in FIG. 2, storage apparatus 10 may be mounted "within" structure 18; in this alternative embodiment, mounting mechanism 12 is preferably disposed on a top side of structure 18 (i.e., extends through structure 18 to attach to storage member 16). Further, it is alternatively contemplated that storage apparatus 10 be disposed in a recessed fashion within structure 18, such as between the joists of a ceiling. This embodiment is illustrated in FIG. 3.

Further, it is contemplated that storage apparatus 10 may include a locking mechanism (not shown), to prevent the accidental and/or unauthorized access or opening of storage apparatus 10.

Figure 4:
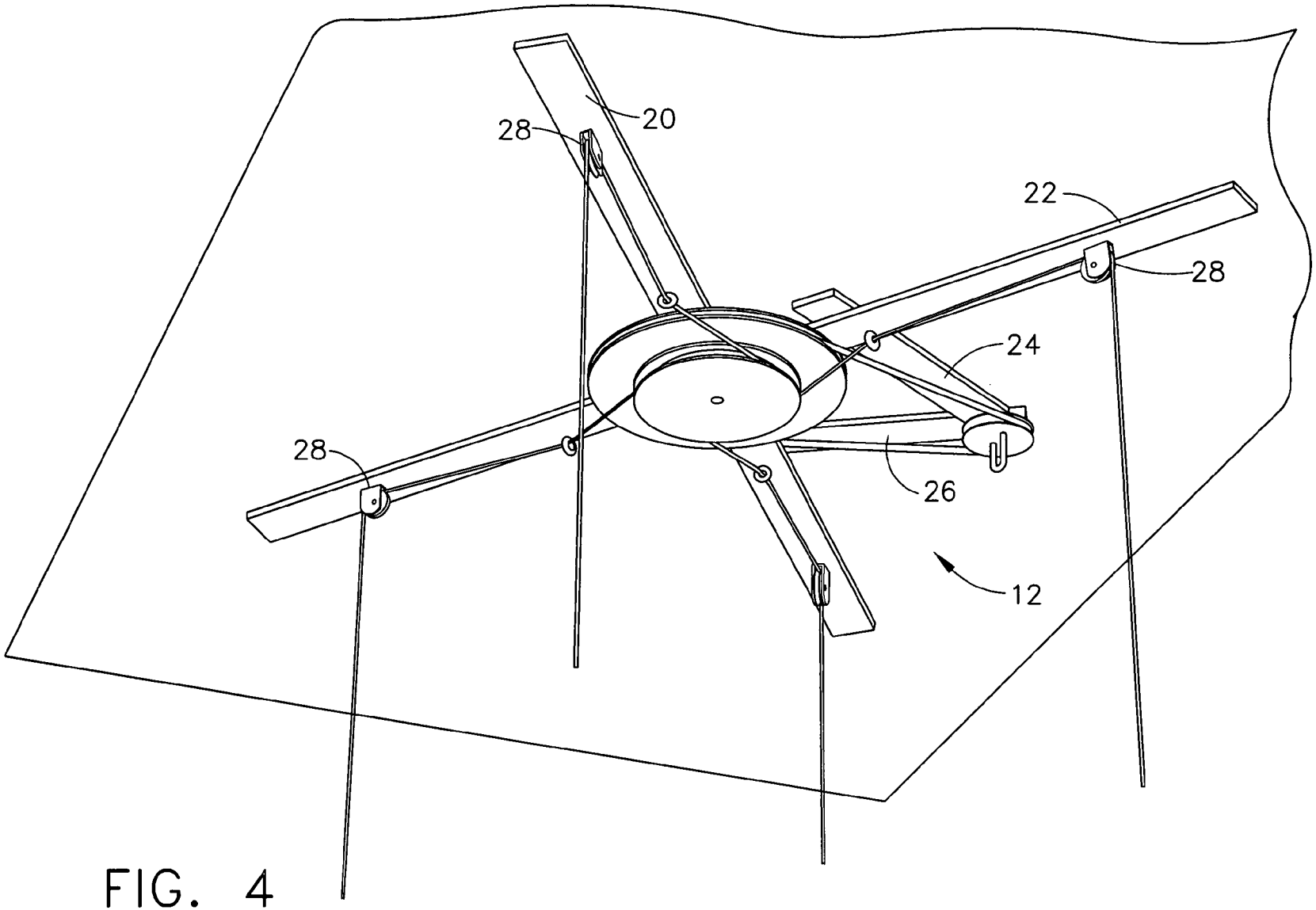
FIG. 4 illustrates a perspective view of one embodiment of the mounting mechanism of the storage apparatus of FIG. 1.

For mounting storage apparatus 10 to ceiling or other structure 18, FIG. 4 illustrates an isolated perspective view of mounting mechanism 12 of storage apparatus 10 and discloses primary support brackets 20, 22. As illustrated in FIG. 4, primary support brackets 20, 22 are illustrated as being arranged in an "X"-shaped fashion, where one primary support bracket 20 may intersect the other primary support bracket 22 at the midpoint of each of primary support brackets 20, 22. Alternatively, in this "X"-shaped embodiment, brackets 20, 22, instead of comprising two intersecting brackets, may comprise four distinct brackets possessing a common convergence point. In such a case, each of the four brackets would fan out from the common convergence point such that the shape of an "X" may still be formed.

As a further alternative to the "X"-shaped embodiment illustrated in FIG. 4, mounting mechanism 12 may be envisioned to comprise other, alternative embodiments. For example, mounting mechanism 12 may comprise four brackets in the shape of a square or rectangle. Additionally, mounting mechanism 12 may comprise two parallel-placed mounting brackets disposed at opposing ends. Finally, it is contemplated that storage apparatus 10 be designed without primary support brackets 20, 22.

Referring again to FIG. 4, mounting mechanism 12 may also include power source mounting brackets 24, 26. Power source mounting brackets 24, 26 preferably allow for the mounting of a power source, which will be described in further detail below, to the ceiling or other structure. It is also contemplated that storage apparatus 10 be designed without power source mounting brackets 24, 26.

For anchoring storage apparatus 10 to a ceiling or other structure 18, mounting mechanism 12 preferably uses fasteners (not shown), such as, for example, screws, nut and bolt assemblies, rivets or any other currently-known anchoring means that is capable of affixing storage apparatus 10 to ceiling or other structure 18. It is also preferred that mounting mechanism 12 be affixed to the structural support mechanism of ceiling or other structure 18 (i.e., the ceiling beams, etc). Doing so will provide the necessary support to hold the weight and mass of storage apparatus 10.

All brackets 20, 22, 24, 26 are preferably made of a sturdy lightweight material, such as, for example, aluminum, steel, magnesium—and any associated alloys, carbon—and any carbon-based products, plastics and polymers, reinforced plastics, metal alloys and other similar composite materials.

In operation, mounting mechanism 12 provides a means by which portions of hoist system 14 may be attached. For example, as illustrated in FIG. 4, to attach hoist system 14 to mounting mechanism 12, pulleys 28 are preferably affixed to brackets 20, 22 of mounting mechanism 12 of storage apparatus 10. Preferably, the means of affixing pulleys 28 to brackets 20, 22 may also be through the use of fasteners (not shown), which may be identical to those described above with reference to the means for anchoring storage apparatus 10 to ceiling or other structure 18.

Figure 5:
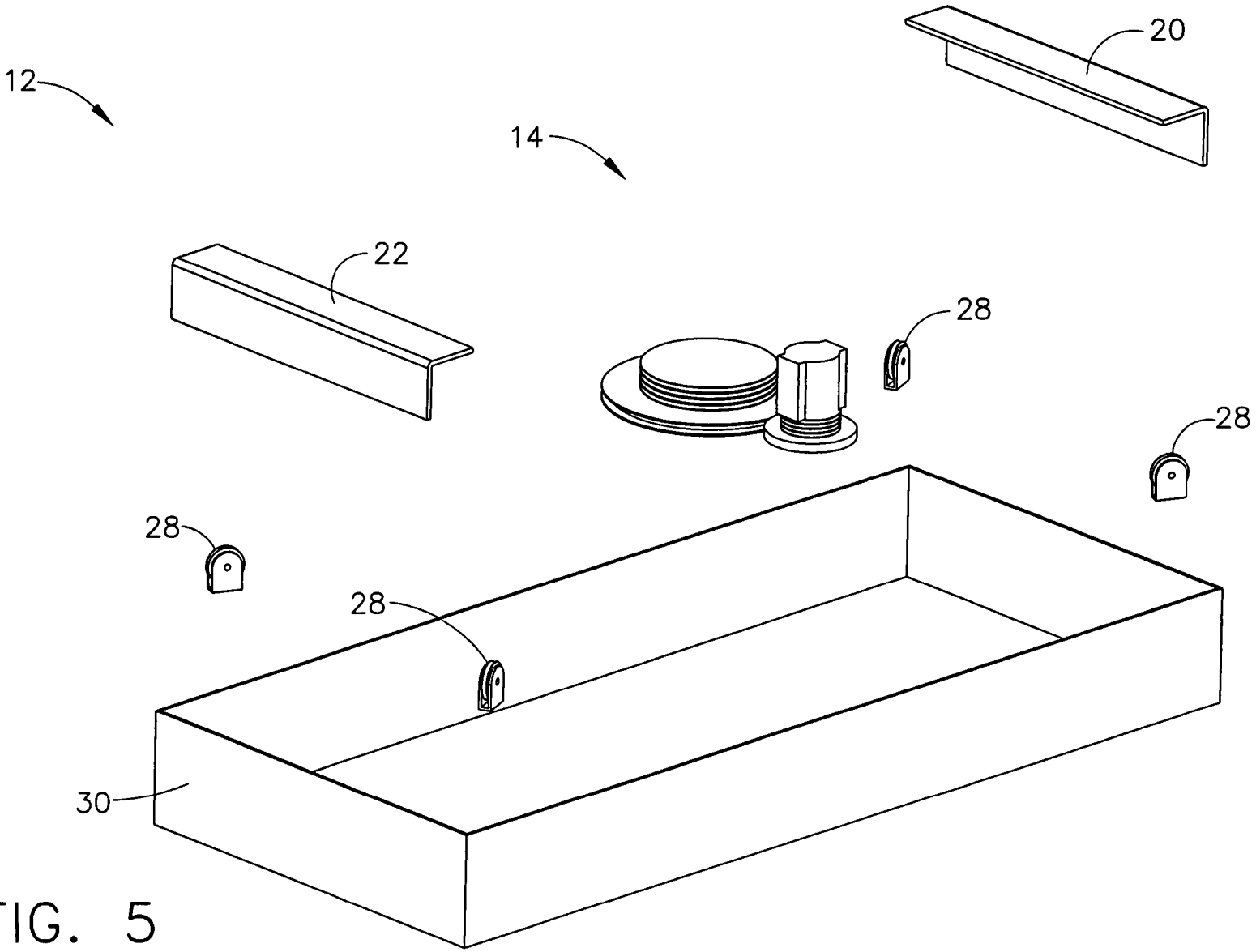
FIG. 5 illustrates a perspective view of another embodiment of the mounting mechanism of the storage apparatus of FIG. 1.

As illustrated in FIG. 5, mounting mechanism 12 may be hidden from view, through the use of housing 30. Housing 30 preferably comprises any sturdy, lightweight material that is sized large enough to cover the mechanisms of both mounting mechanism 12 and hoist system 14.

Also illustrated in FIG. 5 is an alternative embodiment of mounting mechanism 12, as described above. In this embodiment, primary support brackets 20, 22 are arranged in non-intersecting positions. Further, this embodiment does not provide for power source mounting brackets 24, 26. However, it should be noted that the aspects of the two embodiments described herein are interchangeable. That is, for example, the "X"-shaped primary support brackets 20, 22 may be utilized with housing 30 or vice versa.

It is further contemplated that mounting mechanism 12 may possess a covering member, to provide an aesthetically-pleasing look to mounting mechanism 12. This covering member may simply be a screen or a cover plate to visually cover the elements of mounting mechanism 12. Further, it is also contemplated that mounting mechanism 12 may include a light fixture, or other electrical feature (not illustrated), which may be attached to mounting mechanism 12.

Figure 6:
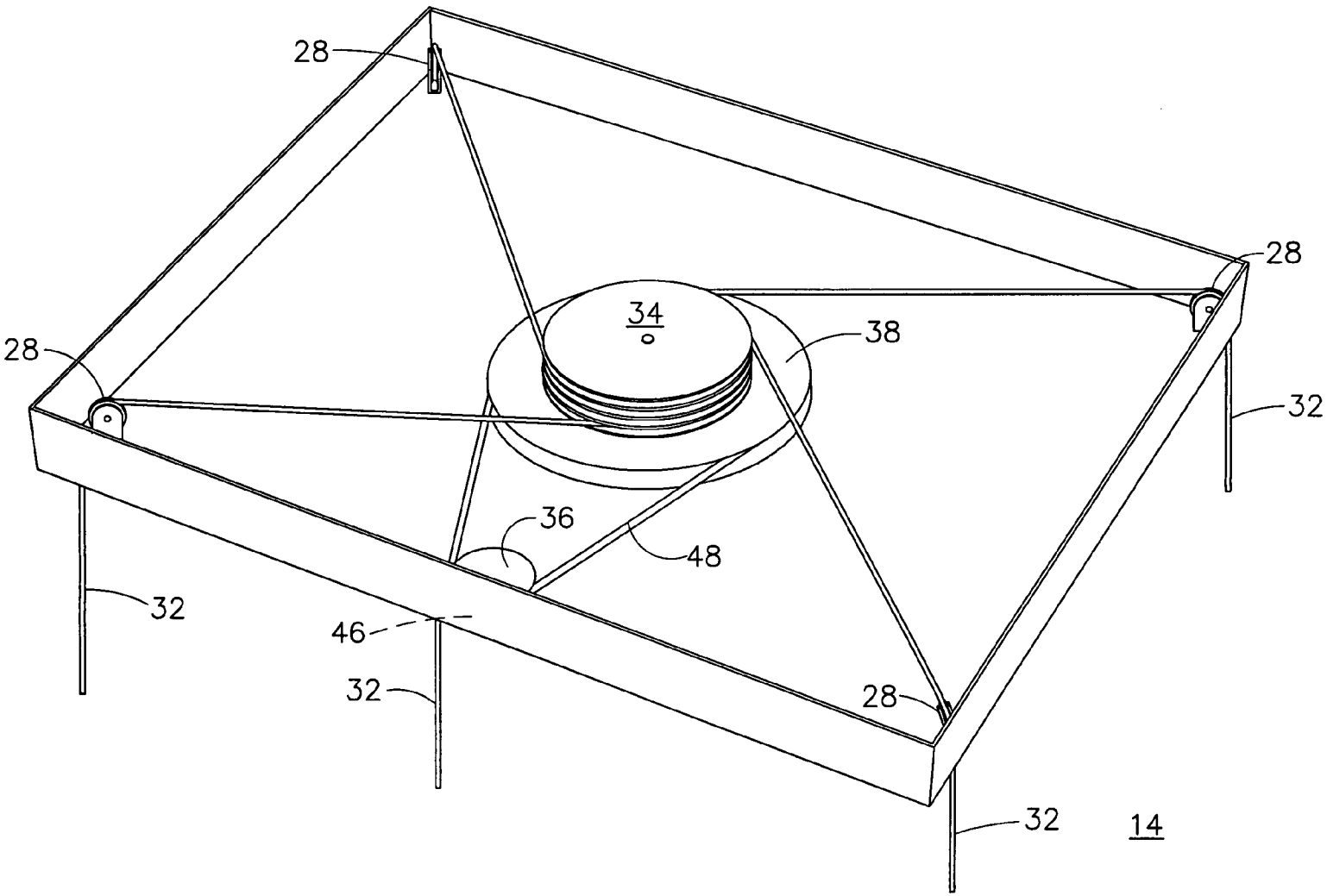
FIG. 6 illustrates a perspective view of one embodiment of the joist system of the storage apparatus of FIG. 1.

For raising and lowering storage member 16 of storage apparatus 10, hoist system 14 is provided. Referring to FIG. 6, hoist system 14 is illustrated as preferably comprising at least the following elements: at least one pulley 28, at least one hoisting wire 32, hoisting wire mount 34 and motoring element 36. As illustrated in FIG. 6, each hoisting wire 32 is affixed to hoisting wire mount 34, inserted through pulley 28 and affixed to a portion of storage member 16 (this connection is not shown in FIG. 6). Preferably, hoisting wire mount 34 of hoist system 14 may also comprise at least one hoisting wire guide 38; it is hoisting wire guide 38 which acts to guide each hoisting wire 32 to and from hoisting wire mount 34. Alternatively, it is contemplated that hoist system 14 may comprise only one cable, extending from hoisting wire mount 34. This embodiment contemplates no use of a pulley and instead envisions the cable splitting into four wires just above storage member 16.

Preferably, each of the pulleys 28 comprises any currently-known pulley (or pulley-type mechanism) that can be used to assist each hoisting wire 32 in the raising and lowering of storage member 16, while at the same time keeping each hoisting wire 32 in an alignment such that the raising and lowering of storage member 16 is done in an efficient manner (i.e., in a stable, smooth and/or level manner, including with no entangling of the hoisting wires 32). To assist in this task, it is preferred that each of the pulleys 28 be affixed at such a point on mounting mechanism 12 (or, alternatively, directly to ceiling or other structure 18) as to allow each hoisting wire 32, which is further affixed to a corner portion of storage member 16, to be aligned perpendicular to the bottom surface of storage member 16. That is, it is preferred that each of the pulleys 28 be affixed to mounting mechanism 12 in such a location to coincide with the approximate location of the corners of storage member 16. It is possible—and sometimes preferable—to mount the wires further in from the actual corners of storage member 16, to compensate for the fact that sometimes the pulley above cannot be positioned directly above the corner of the container.

Each of the hoisting wires 32, as illustrated in FIG. 6, are affixed to hoisting wire mount 34, drawn through one of the pulleys 28, and finally down towards storage member 16, where each hoisting wire 32 is attached. The affixing of each hoisting wire 32 to hoisting wire mount 34 may be by any currently-known means, as is the attachment of each hoisting wire 32 to storage member 16. Preferably, the attachment method selected for the Present Invention allows for adjustment, for both the initial installation and, later, rebalancing of storage member 16. It is also possible that each hoisting wire 32 may wrap around the underside of storage member 16—that is, not actually attached at all, but allowing gravity to hold the container in the "loop" formed by hoisting wire 32. This embodiment may allow the user to remove storage member 16, if necessary. In this situation, it is best for the container to have a retaining channel or a similar element on the sides or underside that keep the wire from slipping out laterally.

Preferably, each hoisting wire 32 is made of any sturdy, lightweight material, such as, for example, steel, rope, plastics or various combinations thereof.

Figure 7:
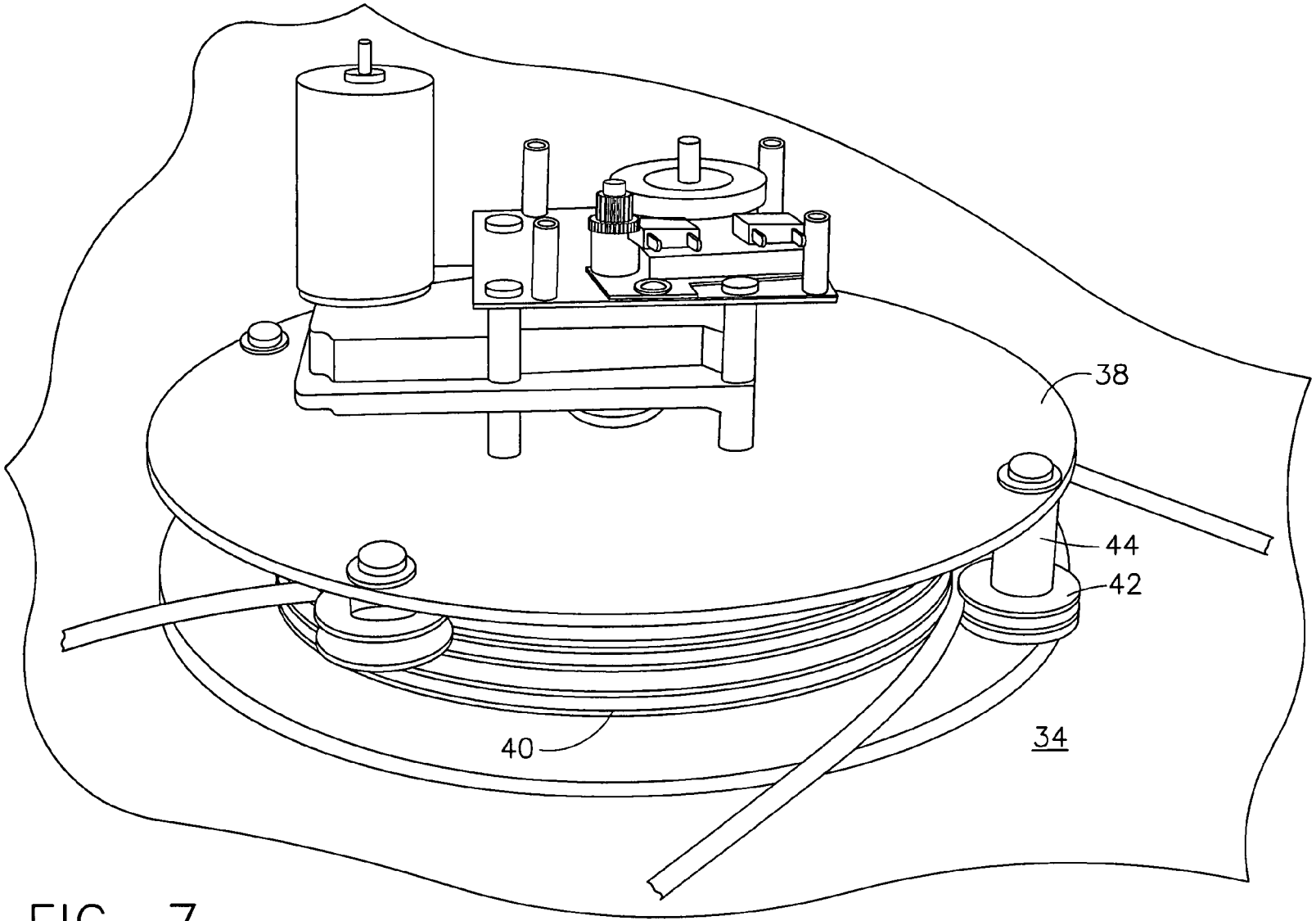
FIG. 7 illustrates a perspective view of one embodiment of the hoisting wire mount of the hoist system of FIG. 6.

Hoisting wire mount 34 is preferably shown in FIG. 6 as comprising concentric pulleys, layered one on top of another, for each hoisting wire 32. Referring to FIG. 7, which illustrates a close-up view of one embodiment of hoisting wire mount 34, it can be seen that each hoisting wire 32 is guided into channel 40 through the use of guide pulley 42. Channel 40 comprises the channel of one of the concentric pulleys, as described above. Each guide pulley 42 is preferably mounted on hoisting wire guide 38 of hoisting wire mount 34 in such a manner as to guide each hoisting wire 32 into one of the channels 40. This is accomplished through the use of various-sized spacers 44. The channels 40 themselves may be configured in a manner to be in vertical alignment with each other, thus allowing one hoisting wire mount 34 to successfully allow for the retraction of more than one hoisting wire 32, while keeping each hoisting wire separate.

Hoisting wire mount 34 of hoist system 14 is propelled by motoring element 36. Referring to FIG. F, motoring element 36 comprises motor 46 and drive belt 48, and preferably comprises any currently known system that can be adapted for raising and lowering storage member 16. Preferably, hoisting wire mount 34 is made of any sturdy, lightweight material, such as, for example, aluminum, steel, wood, various plastics, metal alloys and composite materials.

As illustrated in FIG. 6, there are four pulleys 28 and four hoisting wires 32 in a preferred embodiment of the Present Invention. However, it is nevertheless contemplated that the objects of the Present Invention may be realized through the use of a different number of pulleys and/or hoisting wires. In fact, it is also contemplated that the objects of the Present Invention may be realized through the use of an unequal number of pulleys and hoisting wires.

Figure 8:
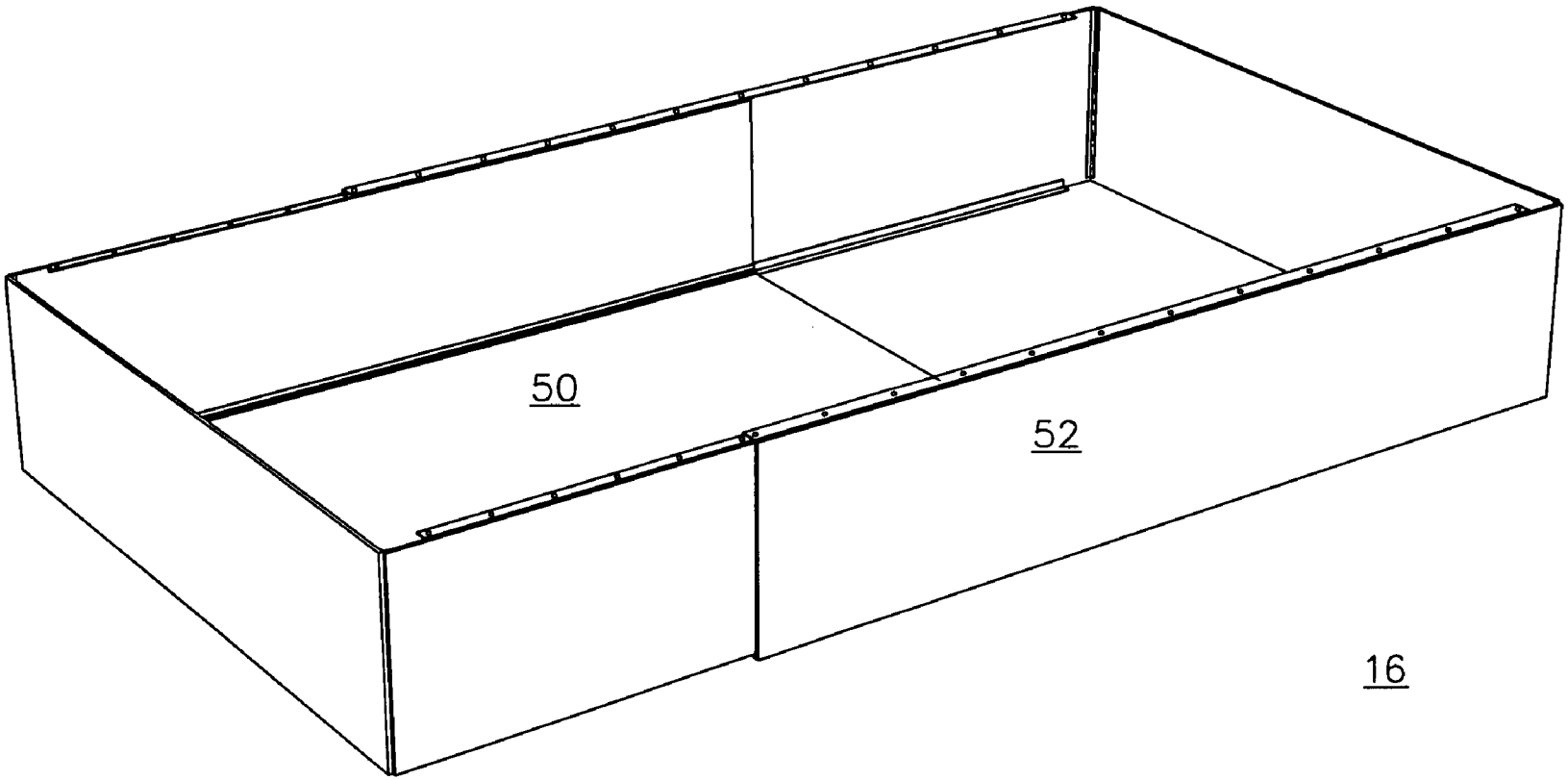
FIG. 8 illustrates a perspective view of one embodiment of the storage member of the storage apparatus of FIG. 1.

For storing various objects, as illustrated in FIG. 8, storage member 16 preferably comprises bottom portion 50 and side portions 52. Preferably resembling a rectangular storage tray, storage member 16 may be formed to resemble any shape or apparatus that is capable of storing various objects of the varying weight, such as, for example, storage containers, electronics equipment, furniture, historical and/or familial items, sports equipment, etc. Although illustrated in FIG. 8 as being open, it is contemplated that storage member 16 may contain a top member (not shown), which can essentially function as a lid. In cases in which a top member is employed, the top member may possess a lock to ensure against any unauthorized access to the contents contained in storage member 16.

While specific embodiments of the present invention have been described in detail, it will be appreciated by those skilled in the art that various modifications and alternatives to those details could be developed in light of the overall teachings of the disclosure. Accordingly, it will be understood that the particular arrangements and procedures disclosed are meant to be illustrative only and not limiting as to the scope of the Present Invention, which is to be given the full breadth of the appended Claims, and any equivalents thereof.

What is claimed is:

1. A storage apparatus comprising:

a mounting mechanism;

a hoist system attached to the mounting mechanism, the hoist system comprising at least one pulley, a hoist wire disposed in each of the at least one pulleys, and a hoist wire mount which receives a first end of each of the hoist wires and a power source; and a storage member affixed to a second end of each of the hoist wires;

wherein the hoist wire mount comprises at least one pulley, each of the at least one pulleys being disposed in a concentric relationship with the other pulleys.

2. The storage apparatus of claim 1, wherein each of the at least one pulleys disposed in the hoist wire mount comprises a channel.

3. The storage apparatus of claim 2, wherein the hoist wire mount further comprises at least one guide pulley to guide each hoist wire into the channel.

* * * * *